US006286766B1

(12) United States Patent
Mitsui et al.

(10) Patent No.: US 6,286,766 B1
(45) Date of Patent: Sep. 11, 2001

(54) PUSH BUTTON FOR POWDER AEROSOL

(75) Inventors: Toshiyuki Mitsui, Saitama-ken; Hideaki Saito, Kawagoe; Takeshi Kato, Sakado, all of (JP)

(73) Assignees: Toyo Aerosol Industry Co., Ltd.; Nivea-Kao Co., Ltd., both of Tokyo (JP)

( * ) Notice: Subject to any disclaimer, the term of this patent is extended or adjusted under 35 U.S.C. 154(b) by 0 days.

(21) Appl. No.: 09/422,232

(22) Filed: Oct. 21, 1999

(30) Foreign Application Priority Data

Feb. 25, 1999 (JP) ..... 11-048855

(51) Int. Cl.[7] ..... B05B 7/24
(52) U.S. Cl. ..... 239/337
(58) Field of Search ..... 239/337, 390–392

(56) References Cited

U.S. PATENT DOCUMENTS

| | | | | |
|---|---|---|---|---|
| 2,693,983 | * | 11/1954 | Howell | 239/337 X |
| 2,995,278 | * | 8/1961 | Clapp | 239/337 X |
| 3,272,442 | * | 9/1966 | Allenbach et al. | 239/337 X |
| 3,284,007 | * | 11/1966 | Clapp | 239/392 |
| 3,684,185 | * | 8/1972 | Milcos | 239/337 |

FOREIGN PATENT DOCUMENTS

| | | | | |
|---|---|---|---|---|
| 0 703 159 | | 3/1996 | (EP) . | |
| 83/00134 | * | 1/1983 | (WO) | 239/337 |

OTHER PUBLICATIONS

Patent Abstracts of Japan, vol. 007, No. 056 (C–155) , Mar. 08, 1983 & JP57 204258 A (Osaka Eyazooru Kogyo KK) , Dec. 14, 1982.
Patent Abstracts of Japan, vol. 007, No. 056 (C–155) , Mar. 08, 1983 & JP 57 204257 A (Osaka Eyazooru Kogyo KK) , Dec. 14, 1982.
Patent Abstracts of Japan, vol. 017, No. 709 (M–1535) , Dec. 24, 1993 & JP05 246475 A (Osaka Aerosol Ind Corp) , Sep. 24, 1993.

* cited by examiner

*Primary Examiner*—Lesley D. Morris
(74) *Attorney, Agent, or Firm*—Kanesaka & Takeuchi

(57) ABSTRACT

A push button for powder aerosol has a push button body, a nozzle and a guide passage. The nozzle is formed in the push button body with a diameter in a range of 0.4 mm to 1.0 mm and a length in a range of 0.3 mm to 2.0 mm in communication with a stem of an aerosol container. The guide passage is formed in the push button body in continuation with an outer end of the nozzle in extending in a spraying direction of the nozzle and formed with a diameter of a range of 1.0 mm to 3.0 mm that is larger than the diameter of the nozzle and a length of a range of 3.0 mm to 20.0 mm for guiding the contents of the powder aerosol. The nozzle flows out the contents with diffusion suppressed, so that accurate application can be made to the limited range on aimed areas such as skins.

7 Claims, 6 Drawing Sheets

PUSH BUTTON FOR POWDER AEROSOL

BACKGROUND OF THE INVENTION

1. Field of the Invention

This invention relates to a push button for powder aerosol attached to an aerosol container for spraying contents of powder aerosol used in such products as deodorants or antiperspirants.

2. Description of Related Art

Conventionally, there are powder aerosol products such as antiperspirants, deodorants, medicines or else in which powder aerosol contents containing solid powders such as talc are sprayed at a human body, and therefore, the powders are applied to the skin of the human body. The contents of the powder aerosol are combined with hydrocarbon oil or ester-based oil components, for example, sesquioleic acid sorbitan; with this oil components used as a spreading agent, it is possible to spreadingly apply the powders at aimed spots of an object such as skin or the like.

Conventional push buttons, however, spray the contents of the powder aerosol radially, and the most of the contents diffuse into the open air, and therefore, it is difficult to spray at the aimed spot sufficiently, resulting in being uneconomical. Although a conventional method in which the more amount of the oil components in the contents is blended improves the ability to apply sufficiently more powders, this method may make dryness of the contents sprayed to the skin worse, so that the user feels sticky and uncomfortable in use. Also, a large amount of the oil components used in this conventional method causes problem that oil drops can easily adhere to an inner round of a nozzle and the like, and therefore, cloggings are made very easily.

A prior art as set forth in Japanese Unexamined Patent Publication (KOKAI) Heisei 5 No. 246,475 discloses that the powder aerosol contents can be sprayed in a stick form by making the nozzle's diameter smaller along in the spraying direction. Such a nozzle tries to spray the powder aerosol contents in a narrower range on the object, as well as to prevent the contents from diffusing into the open air. The nozzle, the diameter of which is made getting smaller as in the spreading direction, however, is easily clogged with the powders and oil components, and therefore, the nozzle may not spray sufficiently. By rendering the sprayed area extremely narrowed, propellants cannot be sufficiently evaporated, and a large amount of the propellants is adhered to skin, resulting in that the strong cold feeling occurs.

According to the inventions disclosed in Japanese Unexamined Patent Publication (KOKAI) Showa 57 No. 204,257 and Japanese Unexamined Patent Publication (KOKAI) Showa 57 No. 204,258, the mist-spraying range can be controllable by placing two different kinds of nozzles at a push button and by attaching the button to the aerosol container by changing suitably the direction of the button.

The nozzle disclosed in the Publication Showa 57 No. 204,257, however, produces diffusingly-spraying mist, so that the nozzle has a low preventive effect against diffusion and a low ability to spreadingly adhere the powders. Although the nozzle disclosed in the Publication Showa 57 No. 204,258, where a long thin pipe is connected to the tip of the nozzle, can spray mist in the thin stick form or straightly sprayed, the nozzle and pipe may be clogged because the powder aerosol contents are subject to strong fluid resistance due to the long channel for spraying. In the case where the spraying range is made extremely narrow by utilizing this pipe, the user feels cold very strongly because the propellants are not vaporized and a large amount of the propellants is adhered to the skin. When such a projecting pipe is used, it is easily subjected to some impacts, and therefore, it is easily broken; also, such a pipe might interfere with some operations and it might be troublesome in storage.

It is an object of the invention, from a viewpoint to solve the problems above, to provide a push button having a high spreadingly applying ability of the powder aerosol contents to the skins, making it possible to achieve an accurate application to the skins and to prevent the contents from diffusing into the open air. While improving the diffusion preventing effect and spreadingly applying ability of the powders, the push button also avoids producing strong cold feeling to the skins and clogging the nozzle, thereby achieving sufficient spraying of the powder aerosol contents.

SUMMARY OF THE INVENTION

To solve the problems above, one form of the invention is formed with a push button body, a nozzle formed in the push button body with a diameter in a range of 0.4 mm to 1.0 mm and a length in a range of 0.3 mm to 2.0 mm for spraying contents of the powder aerosol in communication with a stem of an aerosol container, and a guide passage formed in the push button body in continuation with an outer end of the nozzle in extending in a spraying direction of the nozzle with a diameter of a range of 1.0 mm to 3.0 mm that is larger than the diameter of the nozzle and a length of a range of 3.0 mm to 20.0 mm for guiding the contents of the powder aerosol.

The straight guide passage may have a funnel form opening formed at an outer tip of the guide passage.

The contents of powder aerosol may contain oil components used for powder application in a range of 0.5 to 20.0 percent by weight.

According to the structure of the invention above, a valve assembly opens when the push button of the aerosol container filled with the contents of powder aerosol is pushed. Following the opening of the valve assembly, the contents of the powder aerosol are forced by propellants' pressure to be introduced with propellants through a stem to the inside of the push button.

The contents of the powder aerosol inserted in the push button are broken down into fine grains to spray radially from the nozzle. Because the nozzle has the guide passage in continuation with an outer end of the nozzle in extending in a spraying direction of the nozzle with a diameter larger than that of the nozzle, the particles of the powder aerosol contents hit on an inner wall of the guide passage and flow out straightly in the direction toward the outlet of the guide passage. Then, the contents, being suppressed to diffuse, are sprayed outside from the outlet of the guide passage.

Compared with the case where a nozzle of a conventional art is used for spraying, spraying being suppressed to diffuse allows to adequately prevent the contents of the powder aerosol from diffusion and achieves sure applications of the contents to narrow ranges of the objects such as the skins or the like. When only the nozzle is used for spraying, the contents of the powder aerosol diffuses in a form of mist, so that the number of the particles per unit area decreases and fluid speed of the particles is slow, and so that the contents may not be applied sufficiently even if the contents once applied to the skin. In the case where spraying is suppressed to diffuse according to the invention, however, spreadingly applied or sticking characteristics of powders are improved because the number of the particles per unit area increases and the particles make properly strong contact to the skins. A user feels more comfortable in using the spray with less strong cold feeling in comparison with the prior art in which spraying is made in a stick form, or straightly sprayed at an extremely limited range.

In order to make a push button which can suppress diffusion of powders and have superior spreadingly applied characteristics without producing a strong cold feeling, the diameter of the guide passage should be made larger than that of the nozzle, and sizes of a nozzle, and a guide passage should be set in following ways.

A nozzle is formed with a diameter in a range of 0.4 mm to 1.0 mm and a length in a range of 0.3 mm to 2.0 mm. The diameter of the nozzle is so small, when it is less than 0.4 mm, that it might cause cloggings or the like because spraying the contents of the powder aerosol is extremely suppressed. Alternately, when the diameter of the nozzle is more than 1.0 mm, the amount of the powder aerosol contents for spraying is increasing as a large amount of propellants is sprayed at the same time, which renders undesirable result that strong cold feeling occurs, thereby making the user uncomfortable. Preferably, the nozzle should be formed with a diameter in a range of 0.4 mm to 0.8 mm, and more preferably, in a range of 0.4 mm to 0.6 mm.

When the length of the nozzle is shorter than 0.3 mm, the durability of the nozzle is getting lower, so the nozzle becomes fragile when molded, and also the controlling effect in suppressing the spraying amount is lowered. On the other hand, when the length of the nozzle is longer than 2.0 mm, the fluid resistance of the aerosol contents flowing through the nozzle is larger, thereby causing the controlling effect in suppressing the spraying amount to be too high, resulting in that a sufficient amount of the powder aerosol contents cannot be sprayed.

The guide passage in continuation with the nozzle should be formed with a larger diameter than that of the nozzle, or in a range of 1.0 mm to 3.0 mm and a length in a range of 3.0 mm to 20.0 mm. In other words, when the diameter of the guide passage is less than 1.0 mm, the powder aerosol contents are sprayed in a fine stick form or straightly sprayed. Although the diffusion preventing effect is higher, spraying is strongly applied to the skin, and the applied skin is thickly made up with the contents, and consequently, the user uncomfortably feels cold very strongly due to less evaporation of the propellants. Alternately, when the diameter of the guide passage is larger than 3.0 mm, though spraying is softly applied, the diffusion preventing effect of the powder aerosol contents is lower, and the spreadingly applying ability to the skin becomes worse.

When the length of the guide passage is shorter than 30 mm, the particles of the powder aerosol contents are sprayed without hitting the inner wall of the guide passage, thereby producing a low diffusion preventing effect. When the length of the guide passage is longer than 20.0 mm, although the diffusion preventing effect of the powder aerosol contents is made higher, spraying is strongly applied to the skin, and the user uncomfortably feels cold strongly. It also causes the contents of the powder aerosol to have a strong fluid resistance, and then the oil components or powders in the contents are easily adhered to the inside of the guide passage, thereby causing clogging or liquid dropping.

The guide passage can be integrated with the push button, or it can be formed individually and then connected to the nozzle. In the case where the guide passage is integrated with the push button, forming of the guide passage can be completed as the push button body is molded, providing an easy way for formation of the guide passage. In the case where the guide passage is separately formed from the push button body, a hard material can be used for the guide passage so that the durability to spraying pressure can be improved. When the diameter or the length of the guide passage is required to be changed depending on the kinds of the contents and the purposes for use, another new push button body does not have to be formed; instead, only the guide passage is needed to be formed again, and then connected to the nozzle.

The guide passage can be so formed, within the range of the size mentioned above, as to keep the same diameter from the nozzle to the outer portion in a straight line, but it is also possible to have an opening with a larger diameter, or a funnel form opening formed at an outer tip of the guide passage depending on prescriptions of the powder aerosol contents or purposes for use. The formed funnel form produces a broaden spraying range in width when the contents are sprayed out, and therefore, a user comfortably feels soft when the contents are applied to the skin with better feeling in use.

The improved spreadingly applied characteristic to the object does not require to excessively combine a large amount of oil components in the powder aerosol contents, or the oil components for powder application is just needed to be arranged in a range of 0.5 wt % to 20.0 wt % of the powder aerosol contents. It provides a dry feeling without stickiness and reduces cost by preventing wasteful arrangements of the oil components. It also prevents from clogging, liquid dropping or the like in the nozzle due to the oil components. When the oil component is, however, less than 0.5 wt %, a spreadingly applied characteristic to the skin is lowered and the spreadability of the powders is lower, making it easy for the powders to cohere. When the oil component is more than 20.0 wt %, however, dryness is lost, causing uncomfortable feeling in use by stickiness.

Products having the push button for powder aerosol can be used for antiperspirants, deodorants, body shampoos, dermatophytosis medicines, insect repellents, salves, burning medicines, skin disease treatments, external medicines or the like.

BRIEF DESCRIPTION OF THE DRAWINGS

The above and other objects and features of the invention are apparent to those skilled in the art from the following referred embodiments thereof when considered in conjunction with the accompanied drawings, in which.

DETAILED DESCRIPTION OF PREFERRED EMBODIMENTS

Referring to FIGS. 1 to 6, a push button for powder aerosol according to the invention as a first embodiment is shown. Numeral 1 designates a push button for powder aerosol. The push button for powder aerosol 1 is connected to a bottom end of a stem (not shown) of an aerosol container (not shown). The stem is connected to a valve assembly (not shown) for an aerosol container filled with powder aerosol contents containing solid powder components, oil components, repellents and the like. By pushing down the stem using the push button 1, the valve assembly opens to introduce the powder aerosol contents from the stem to a passageway 2 of the push button 1.

Figure 1:
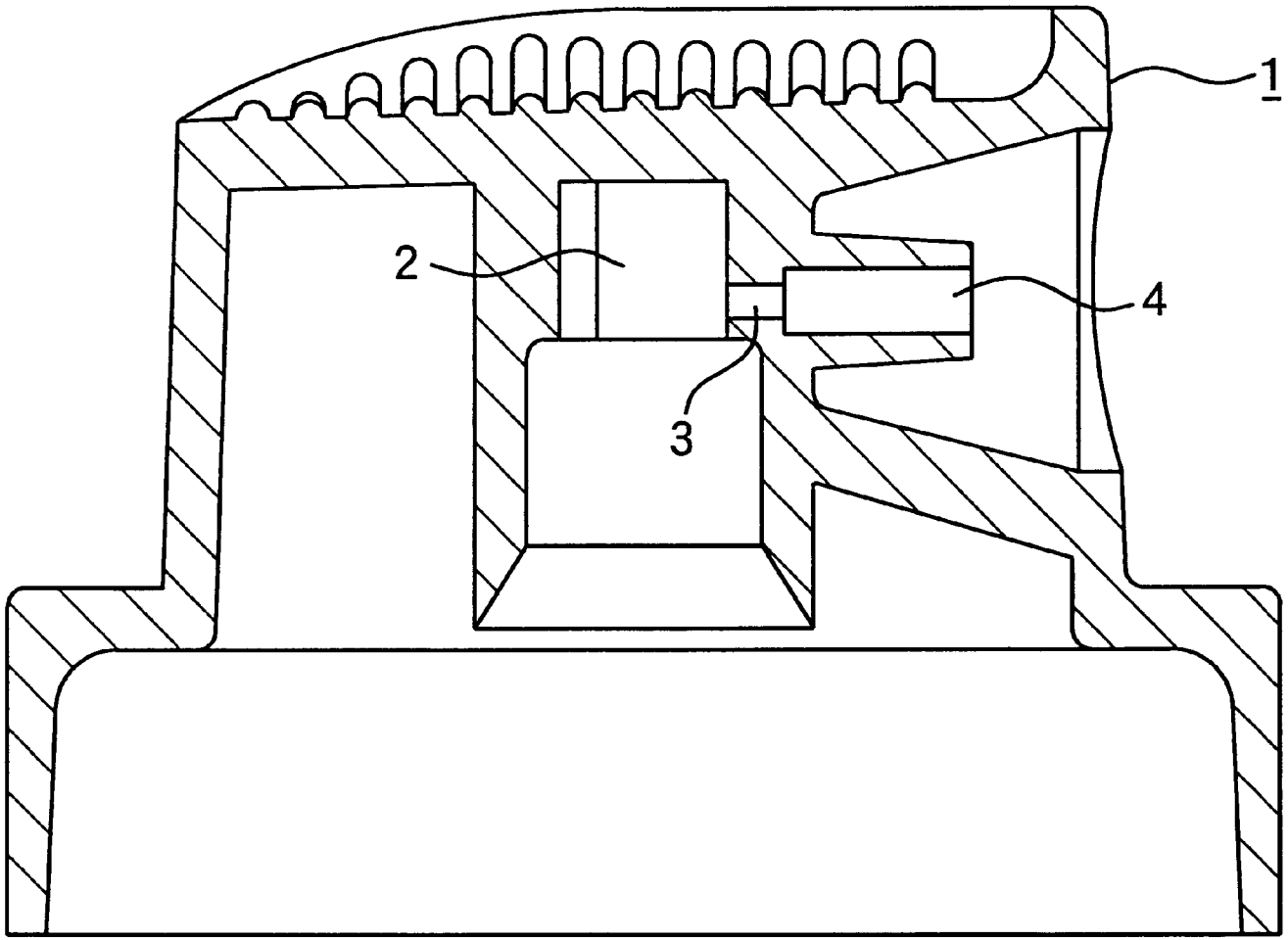
FIG. 1 is a cross section showing a push button of the first to fifth embodiments according to the invention.

The passageway 2 is in communication with a nozzle 3 formed at a side surface of the push button 1. The nozzle 3 can spray the contents of the powder aerosol and has a guide passage 4 for the contents in continuation with an outer end of the nozzle in extending in a spraying direction of the nozzle 3. The guide passage 4 according to the embodiment shown in FIG. 1 is incorporated in the completed body of the push button 1 when it is molded with the same material as that of the push button 1.

The diameter of the guide passage 4 is wider than that of the nozzle 3 to prevent the powder aerosol contents from clogging. The nozzle 3 is formed with a diameter A in a range of 0.4 mm to 1.0 mm and a length a in a range of 0.3 mm to 2.0 mm.

In other words, when the diameter A of the nozzle 3 is smaller than 0.4 mm, the diameter A is so small that the nozzle 3 is clogged with the powder aerosol contents. When the diameter A is wider than 1.0 mm, a spraying amount of the powder aerosol contents is larger, and consequently, a large amount of the propellants is sprayed, which is not preferable because strong cold feeling is created, thereby making the user uncomfortable. It is preferable to form the diameter of the nozzle 3 in a range of 0.4 mm to 0.8 mm, more preferably 0.4 mm to 0.6 mm.

When the length a of the nozzle 3 is shorter than 0.3 mm, the nozzle has less durability, which causes to break the nozzle 3 easily when molded, and also a controlling effect in suppressing spraying amount is lowered. Alternately, when the length a of the nozzle 3 is longer than 2.0 mm, a fluid resistance of the aerosol contents flowing into the nozzle 3 is higher, resulting in that a controlling effect in the spraying amount is too high to spray an enough amount of the powder aerosol contents.

The guide passage 4 in continuation with this nozzle 3 has a diameter B in a range of 1.0 mm to 3.0 mm and a length b in a range 3.0 mm to 20.0 mm. When the diameter B of the guide passage 4 is smaller than 1.0 mm, though the contents of the powder aerosol are sprayed in a thin stick form, or straightly sprayed, which produces a high diffusion preventing effect of powders, spraying is applied strongly to the skin, and the powders are thus thickly covered, or the user may uncomfortably feel cold very strongly because of less vaporization of the propellants. On the other hand, when the diameter B is larger than 3.0 mm, though spraying to the skin is applied more softly, the diffusion suppressing effect of the powder aerosol contents is lowered, producing less spreadingly applied characteristics of the powders to the skin.

When the length b of the guide passage 4 is shorter than 3.0 mm, the powder aerosol contents are sprayed radially, making the diffusion preventing effect lowered. Alternatively, when the length b is longer than 20.0 mm, though the diffusion preventing effect is higher, spray is strongly applied, thereby giving strongly cold feelings to the user's skin. It also causes a strong fluid resistance of the powder aerosol contents, and therefore, the oil components and powders are easily adhered to the inside of the guide passage 4, producing cloggings.

To spray out the powder aerosol contents with the push button mentioned above, the push button 1 is pushed to open the valve assembly for the aerosol container, thereby introducing the powder aerosol contents through the stem into the passageway 2. The powder aerosol contents having been introduced in the passageway 2 flow through the nozzle 3 in communication with the passageway 2 into the guide passage 4 in continuation with an outer end of the nozzle in extending a spraying direction of this nozzle 3. The powder aerosol contents, when flowing out from the nozzle 3, are broken down into fine grains and sprayed out in the diffusing directions. The diffusion of the contents, however, is suppressed since the contents hit the inner wall of the guide passage 4, so the powder aerosol contents flow out straightly in the going-out direction through the guide passage 4. As a result, the powder aerosol contents are sprayed outside with diffusion suppressed.

Due to suppressed diffusion of the powder aerosol contents in spraying outside, the powder aerosol contents do not wastefully diffuse in the open air, and therefore, it is possible to carry out the accurate application within the narrow range to the object area such as skin, thereby achieving an efficient use of the powder aerosol contents. In addition, with suppressed diffusion of the contents in spraying out, a large number of the particles of the contents per area unit is sprayed out, and therefore, they are strongly applied to the skin, improving the spreadingly applied characteristics to the skin.

Figure 2:
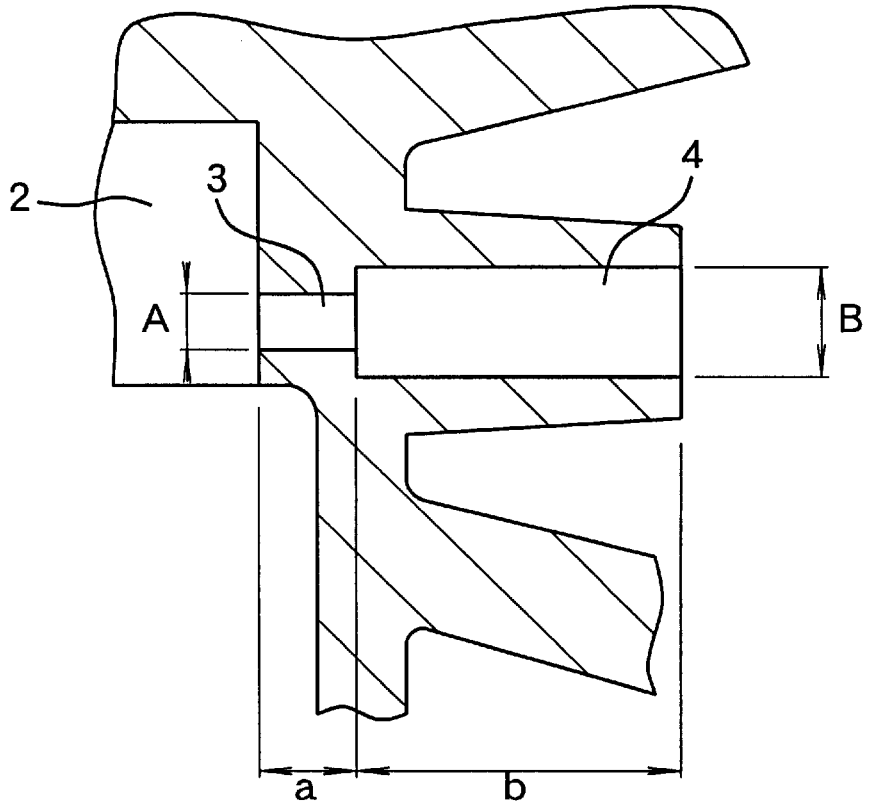
FIG. 2 is an enlarged cross section showing a nozzle and a guide passage portion in FIG. 1.
Figure 3:
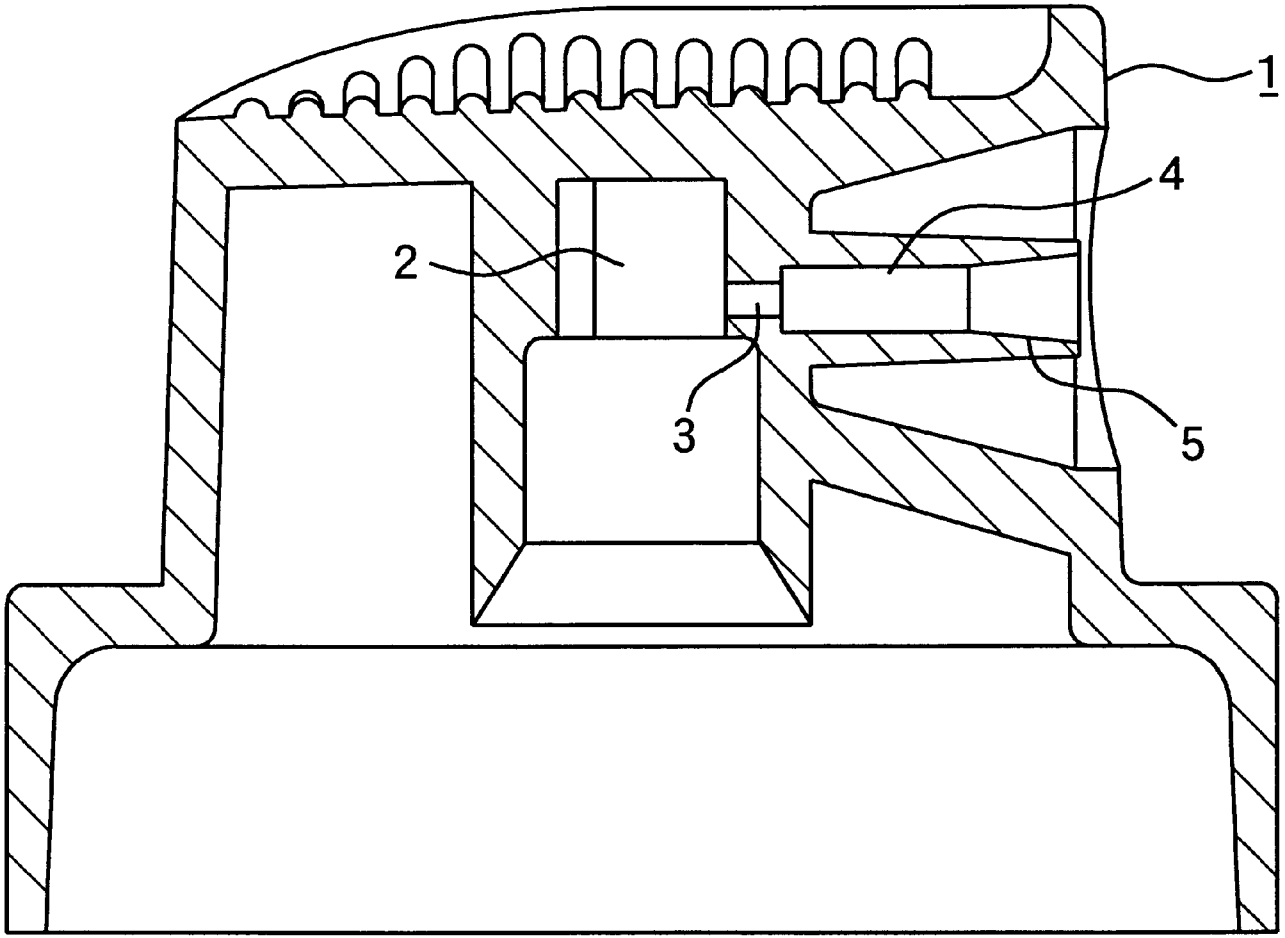
FIG. 3 is a cross section showing a push button of the sixth embodiment in which a funnel form opening is formed at the tip of a guide passage.
Figure 4:
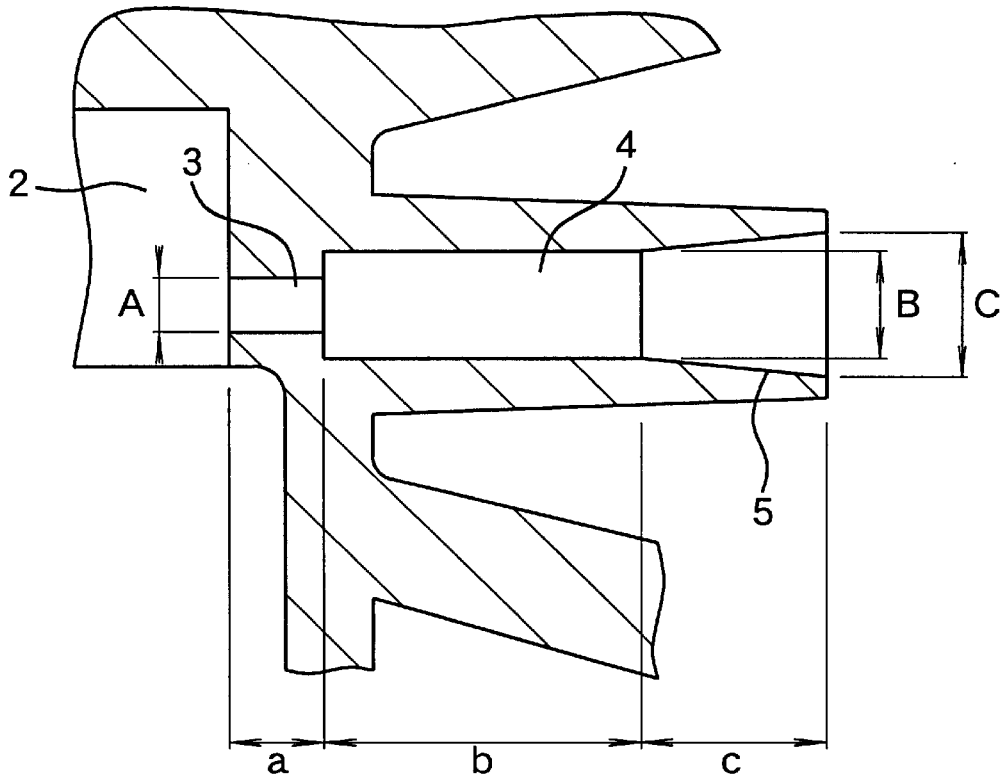
FIG. 4 is an enlarged cross section showing a nozzle and a guide passage portion in FIG. 3.

In the push button 1 according to the embodiment shown in FIG. 1 and FIG. 2, the guide passage 4 is straightly formed, keeping the same diameter from the nozzle 3 to the outer end. On the other hand, in the push button 1 according to the embodiment shown in FIG. 3 and FIG. 4, the guide passage 4 has a funnel form opening 5 formed with a wider diameter at an outer tip of the guide passage 4. A diameter C of the funnel form opening 5 shown in FIG. 4 is formed in the range of 1.0 mm to 3.0 mm which is the same as that of the diameter of the mentioned guide passage 4. The total length of the straight portion b in FIG. 4 and the length c of the funnelform opening 5 is to be made within the range of 3.0 mm to 20.0 mm.

By forming the funnelform opening 5 at a tip of the guide passage 4, the powder aerosol contents, having been suppressed from diffusion, but at the same time under high spraying pressure, get a wider spraying range at the funnelform opening 5 just before spraying outside. As a result, antiperspirants for providing coolness, for example, can give a softer contact with a skin, without causing a strong cold feeling, thereby making the user feel comfortable in using the spray. With the tip's diameter wider, cloggings of the nozzle 3 or the guide passage 4 are preventable.

In the case where the straight portion b of the guide passage 4 is proportionally long to the length c of the funnelform opening 5, the diffusion preventing effect is lowered. The diffusion preventing effect is also lowered when a large difference exists between the diameter B of the straight portion of the guide passage 4 and the diameter C of the funnelform opening 5, so it is preferable to take into consideration when the funnelform opening 5 is formed.

Experiments were carried out to verify a diffusion preventing effect and a spreadingly applying ability of the push button 1. Table 1 below shows the detailed specifications of each push button 1 used in the experiments, prescriptions of the powder aerosol contents, spraying characteristics, the results recorded, or the else.

TABLE 1

| | | | Examples | | | | | | Prior Art |
|---|---|---|---|---|---|---|---|---|---|
| | | | 1 | 2 | 3 | 4 | 5 | 6 | 1 |
| Push Button Specification | Nozzle | Nozzle Diameter (size of portion A) [mm] | 0.51 | 0.51 | 0.51 | 0.51 | 0.51 | 0.51 | 0.51 |
| | | Nozzle Length (size of portion a) [mm] | 1.0 | 1.0 | 1.0 | 1.0 | 1.0 | 1.0 | 0.51 |
| | Guide Passage | Guide Passage Diameter (size of portion B) [mm] | 1.0 | 1.3 | 1.5 | 1.5 | 1.5 | 1.5 | — |
| | | Guide Passage Length (size of portion b) [mm] | 5.0 | 5.0 | 3.0 | 5.0 | 10.0 | 5.0 | — |
| | | Funnelform Opening Diameter (size of portion C) [mm] | — | — | — | — | — | 2.0 | — |
| | | Funnelform Opening Length (size of portion c) [mm] | — | — | — | — | — | 1.5 | — |
| Spraying Characteristics (25° C.) | | Product Pressure [MPa] | 0.24 to 0.26 | 0.24 to 0.26 | 0.24 to 0.26 | 0.24 to 0.26 | 0.24 to 0.26 | 0.24 to 0.26 | 0.24 to 0.26 |
| | | Spraying Amount [g/10 s] | 4.0 to 4.4 | 4.1 to 4.5 | 4.1 to 4.5 | 4.1 to 4.5 | 4.1 to 4.5 | 4.1 to 4.5 | 4.2 to 4.6 |
| | | Spray Pattern [mm/15 cm] Length | 28 to 30 | 29 to 31 | 32 to 34 | 28 to 30 | 27 to 29 | 26 to 28 | 30 to 32 |
| | | Width | 28 to 30 | 29 to 31 | 32 to 34 | 28 to 30 | 27 to 29 | 26 to 28 | 30 to 32 |
| | | Spreadingly applying rate [wt %] | 8.2 to 8.9 | 8.0 to 8.5 | 4.3 to 4.7 | 7.9 to 8.5 | 8.8 to 9.2 | 8.1 to 9.0 | 3.6 to 3.9 |
| Prescription (Common to all) | | Talc | 4.00 wt % | | | | | | |
| | | Myristic acid isopropyl | 1.80 wt % | | | | | | |
| | | Sesquioleic acid sorbitan | 0.20 wt % | | | | | | |
| | | LPG(1.5 kg/cm$^2$:20° C.) | 94.00 wt % | | | | | | |
| | | Total | 100.00 wt % (NET. 45 g) | | | | | | |
| Valve Assembly (Common to all) | | Diameter of Stem [mm] | 0.51 | | | | | | |
| | | Diameter of Housing [mm] | 1.58 (Inlet Chamber) 0.76 (Vapor tap bore) | | | | | | |

Referring to the first to the fifth examples in Table 1, each push button 1 body had a straightly formed guide passage 4 in the same way as shown in FIG. 1 and FIG. 2. Although the nozzles 3 of the example 1 to 5 were formed with the same diameter and length, each guide passage 4 had a different diameter and length, the example 6 used a push button 1 (body), in which the guide passage 4 had a funnelform opening 5 as shown in FIG. 3 and FIG. 4, but the nozzle 3 was formed in the same size as the nozzles 3 of the first to fifth examples.

As an example of prior art, an experiment was carried out using a publicly known push button with a nozzle which is not connected to a guide passage. This prior art had a two-piece type push button in which the nozzle is formed with a spraying tip. These seven types of push buttons 1 were connected to aerosol containers to conduct spraying experiments of the powder aerosol contents.

As for the contents of the powder aerosol used in the examples, talc was a solid powder component, myristic acidisopropyl and sesquioleic acid sorbitan were oil components, and LPG is a propellant. These components were blended in the proportion shown in Table 1, and net amount of 45g was filled in the aerosol container. As shown in the valve specification in Table 1, the valve assembly connecting to each push button 1 had a stem formed with a diameter of 0.51 mm, and an inlet for the powder aerosol contents formed at the bottom end of a housing was designed to have the diameter of 1.58 mm. The housing had a vapor tap bore formed with a diameter of 0.76 mm for introducing propellants.

The experiments were conducted in the room kept at 25° C., wherein a stainless steel plate was set 15 cm away from the aerosol container, and the contents of powder aerosol were sprayed toward the plate for ten seconds with a certain spraying pressure in a certain spraying amount. After the ten seconds passed, a weight of adhered materials on adhesives to the stainless steel plate was measured. To show spreadingly applying ability in percentage, weight of the adhesives is divided by the spraying amount for ten seconds. In addition, by measuring length and width of the adhered materials, spraying patterns of the powder aerosol contents were studied and diffusing conditions were measured.

The results in Table 1 show that the spraying patterns made by the push button 1 of the first to sixth examples according to the invention were left in a narrower range in comparison with the conventional push button or prior art, thereby providing high diffusion preventing effect. The most of the push buttons according to the invention records higher spreadingly applying rate that is equal to or more than twice as that of the conventional push button or prior art, showing a great spreadingly applying ability. The push button of the third example has a lower diffusion preventing effect and a spreadingly applying rate than those of the other examples due to the shorter guide passage 4, but it records better results in terms of the above aspects than that of the prior art example. The guide passage 4 having the same diameter of 1.5 mm as that of the third example, however, is able to have a higher diffusion preventing effect and a spreadingly applying rate by extending the length of the guide passage 4 as shown in the fourth and fifth examples.

Figure 5:
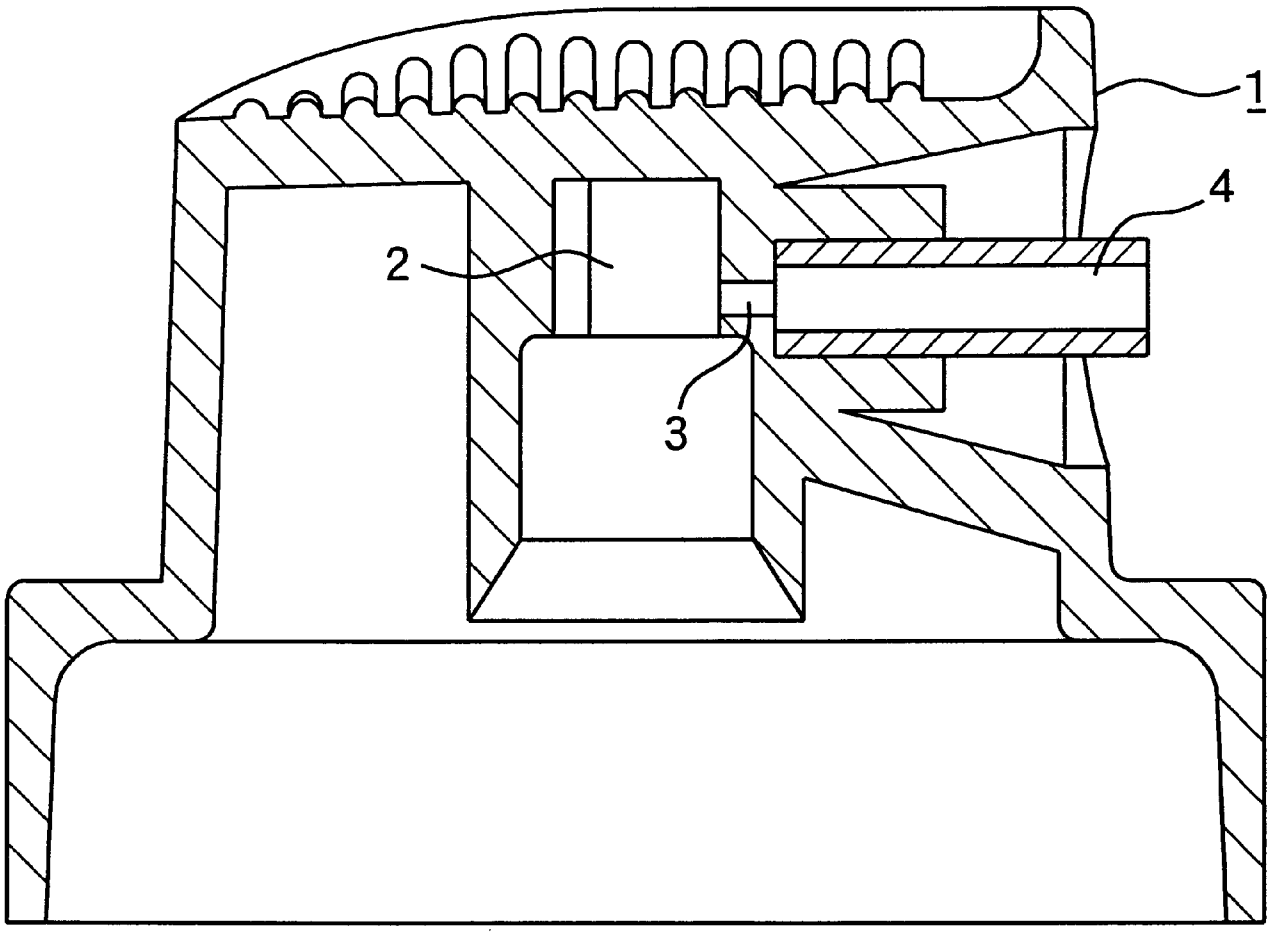
FIG. 5 is a cross section showing a push button of the seventh embodiment in which a guide passage is separately formed.
Figure 6:
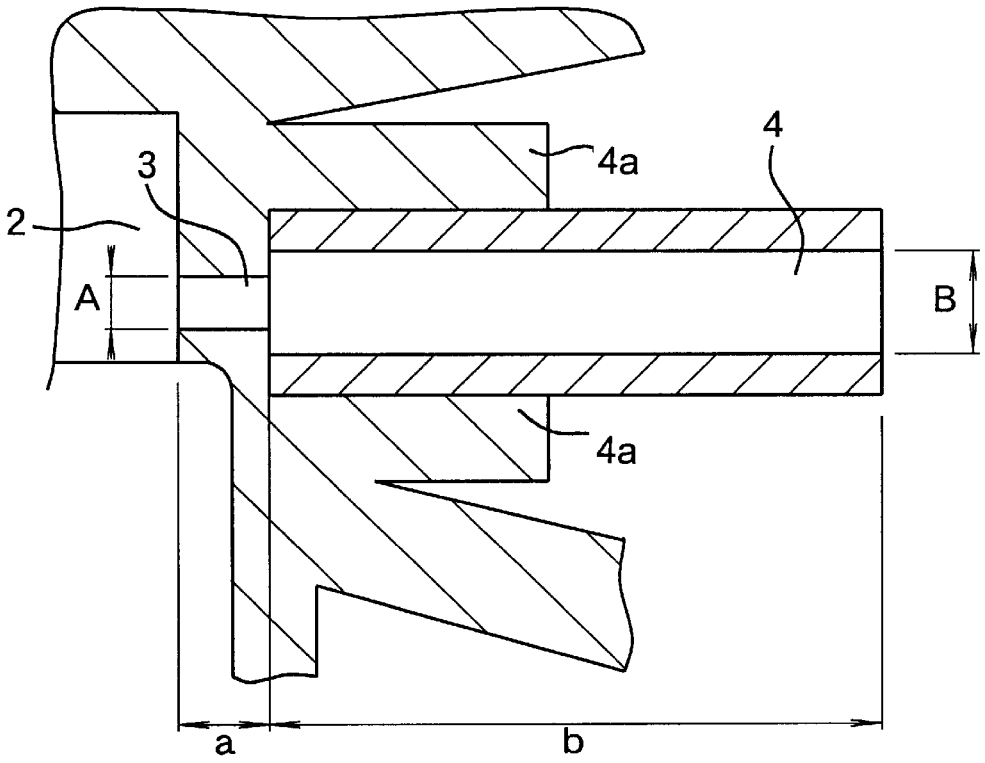
FIG. 6 is an enlarged cross section showing a nozzle and guide passage in FIG. 5.

In the first to sixth examples, the guide passage 4 is formed integrally in the push button 1, decreasing the number of the procedures for molding, but the push button 1 has to be wholly restructured where the size of the guide passage 4 is changed. In the seventh experiment, however, the guide passage 4 is separately formed from the push button 1 as shown in FIG. 5 and FIG. 6, thereby making it possible to attach the nozzle 3 at a later stage of the assembling procedure. In this case, although it requires more number of stages for the procedure of molding or assembling, it requires to switch only the guide passage 4, if needed, so whole restructure of the push button 1 is no more required. As a result, the push button 1 can be used with the nozzle 3 freely attached to the guide passage 4, which is changeably formed with an appropriate size depending on the kinds of the powder aerosol contents or the purpose of use.

In this case, the push button body has a support portion 4*a* with a hole 4*b*, in which the guide passage 4 is inserted.

Furthermore, in the first to sixth experiments, the push button 1 body and the guide passage 4 are made of the same material, but in the seventh experiment, the guide passage 4 can be made of a different material from that of the push button 1. For example, if the push button 1 body is made of HDPE (High-Density Polyethylene) which is inexpensive and easy to be formed and the guide passage 4 is made of a hard material, for example, POM (Polyoxymethylene), this results in that the guide passage 4 can have a higher durability, and therefore, the push button is difficult to be broken under strong spraying force.

As shown in the above, the push button 1 according to the invention has a high diffusion preventing effect and a spreadingly applying ability; therefore, a large amount of oil components does not have to be arranged for spreadingly applying powders, thereby achieving improvements economically. Thus, it is enough to blend oil components in the range of 0.5 wt % to 20.0 wt % of the whole weight. When the oil component is, however, less than 0.5 wt %, the ability to spread the powders is lowered, making it easy to cohere the powders, and a spreadingly applying ability is lowered. When the oil component is more than 20.0 wt %, however, a dryness is lowered, giving the user sticky feelings and making the user displeasing in use. It is preferable to arrange oil components in the range of 2.0 wt % to 10.0 wt %.

Powders are blended in the range of 0.5 wt % to 20.0 wt % of the whole weight. When the powders are blended in less than 0.5 wt %, deodorant effect, antiperspirant effect, treatment effect and others are lowered, so powders do not work as the product as designed. When the powders are blended in more than 20.0 wt %, however, cloggings may be caused not only in the nozzle 3 and guide passage 4 but also in the valve assembly. The clogging in the valve assembly might cause a gap in the valve seat or the like, resulting in the leakage of the powder aerosol contents. It is preferable to blend solid powders in the range of 1.0 wt % to 10.0 wt %.

In the examples above, solid powders, oil components and propellants are blended in the powder aerosol contents, but others such as perfume or the like for personal preference, or essences of Japanese green tea and dibucaine chloride for better effects can be blended. These components are preferably blended in a range of 0.0 wt % to 10.0 wt %. A perfume or the like, for example, does not affect any effectiveness of the products where no amount is blended, but it does, when the perfume blended in 10.0 wt % or more, because the perfume might be disliked due to its strong smell.

The repellants used for spraying those components above is preferably arranged in the range of 50.0 wt % to 99.0 wt %. When the blended amount is less than 50.0 wt %, spraying force for powder aerosol contents is lowered. Alternatively, when the amount is 99.0 wt % or more, the designed effectiveness as aerosol products is lowered, and the application to the skin is so strong and a strong coldness is felt, thereby making the user feel uncomfortable in using the aerosol.

Considering the mentioned above, Table 2 shows five examples of prescriptions of antiperspirant-deodorant powder sprays.

TABLE 2

| Antiperspirant-Deodorant Powder | | (wt %) | | | | |
|---|---|---|---|---|---|---|
| | Spray | 1 | 2 | 3 | 4 | 5 |
| Solid Powder Components/ Elements | Talc | 1.0 | 1.0 | 1.5 | 2.3 | 0.5 |
| | Chlorhydroxy aluminum | 1.7 | 1.5 | 3.0 | 2.6 | — |
| | Silicic acid anhydride | 0.3 | — | 1.5 | 0.4 | — |
| | Zinc oxide | — | — | 0.5 | — | — |
| | Cellulose powder | — | — | — | — | 0.5 |
| Oil Components | Myristic acid isopropyl | 4.0 | 1.0 | 2.1 | 0.9 | — |
| | Triisosterian acid POE grisein | 1.5 | — | — | — | — |
| | Sorbitan fatty acid ester | — | — | 0.3 | — | 0.5 |
| | Methyl polysiloxane | — | 0.9 | — | 2.0 | — |
| | Dimethyl siloxane methyl siloxane copolymer | — | 0.1 | — | — | — |
| | Dimethyl polysiloxane | — | — | 1.0 | 0.2 | 0.5 |
| | Octyl dodecanol | — | 0.3 | — | — | — |
| | 99% Ethyl alcohol | — | — | — | — | 17.9 |
| Other components | Perfume | 0.5 | 0.1 | 0.1 | 0.1 | 0.1 |
| | Essence of Japanese green tea | — | 0.1 | — | — | — |
| Propellants | LPG | 91.0 | 95.0 | 90.0 | 91.5 | 80.0 |
| Totals | | 100.0 | 100.0 | 100.0 | 100.0 | 100.0 |

Table 3 shows prescription examples of other human body treatment goods such as insect repellents, dermatophytosis medicines and salves.

TABLE 3

| Human body treatment goods | | (wt %) | | |
|---|---|---|---|---|
| | | Insect repellents | Dermatophytosis medicines | Salves |
| Solid powder components | Talc | 8.0 | 8.0 | 6.97 |
| | Kaolin | 2.0 | — | — |
| | Zinc oxide | — | 1.0 | — |
| | Silicic acid anhydrode | — | — | 0.2 |
| | Acrinol | — | — | 0.1 |
| Oil components | N,N-Diethyl toluamide | 5.0 | — | — |
| | Myristic acid isopropyl | — | 3.0 | 1.5 |
| | Tolunaphthate | — | 0.3 | — |
| | Squarane | — | — | 1.0 |
| | Sesqui oleic acid sorbitan | — | — | 0.1 |
| Others | Perfume | 1.0 | — | — |
| | Dibucaine hydrochloride | — | — | 0.03 |
| | Allantoin | — | — | 0.1 |
| Repellants | LPG | 84.0 | 87.7 | 90.0 |
| Totals | | 100.0 | 100.0 | 100.0 |

The invented push button for powder aerosol thus constituted is able to spread accurately within the narrow area of the object by suppressing the spreading of the powder aerosol contents when the powder aerosol contents are sprayed, thereby achieving an improved higher spreadingly applying ability of powders. Although application of the contents is made in the narrow area of the object, uncomfortably strong cold feeling does not occur to the user. Because a high spreadingly applying ability does not require much of oil components used for spreading powders, stickiness by the oil components can be avoided, providing a comfortable feeling in use.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but defined claims set forth below.

What is claimed is:

1. A push button for powder aerosol comprising:

a push button body;

a nozzle formed in the push button body with a diameter in a range of 0.4 mm to 1.0 mm and a length in a range of 0.3 mm to 2.0 mm for spraying contents of the powder aerosol in communication with a stem of an aerosol container; and a guide passage formed separately from the push button body and attached to the push button body coaxially with the nozzle, said guide passage communicating with an outer end of the nozzle and extending in a spraying direction of the nozzle with a diameter of a range of 1.0 mm to 3.0 mm that is larger than the diameter of the nozzle and a length of a range of 3.0 mm to 20.0 mm for guiding the contents of the powder aerosol, said guide passage having a straight portion with a uniform diameter at least in a portion from the outer end of the nozzle to an outer tip of the guide passage.

2. The push button for powder aerosol according to claim 1, wherein the straight portion of the guide passage has a funnelform opening formed at an outer tip of the guide passage.

3. The push button for powder aerosol according to claim 1, wherein the contents of powder aerosol contain an oil component for powder application in a range of 0.5 to 20.0 percent by weight.

4. The push button for powder aerosol according to claim 1, wherein said straight portion with the uniform diameter extends from the outer end of the nozzle to at least a middle portion of the guide passage.

5. The push button for powder aerosol according to claim 4, wherein said nozzle and said guide passage have cylindrical shapes.

6. The push button for powder aerosol according to claim 5, wherein said push button body further includes a passageway communicating with the aerosol container, said nozzle being arranged perpendicular to the passageway.

7. The push button for powder aerosol according to claim 1, wherein said push button body has a support portion with a hole, in which the guide passage is inserted.

* * * * *